US007632365B1

(12) United States Patent
D'Arche et al.

(10) Patent No.: US 7,632,365 B1
(45) Date of Patent: Dec. 15, 2009

(54) PYROTECHNIC THERMITE COMPOSITION

(75) Inventors: Steven P. D'Arche, Odon, IN (US); Travis Swanson, Bloomfield, IN (US); Brian Melof, Edgewood, NM (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 282 days.

(21) Appl. No.: 11/144,849

(22) Filed: Jun. 6, 2005

(51) Int. Cl.
*C06B 33/00* (2006.01)
*C06B 33/12* (2006.01)
*C06B 33/02* (2006.01)

(52) U.S. Cl. ..... 149/37; 149/40; 149/44

(58) Field of Classification Search ..... 149/37, 149/40, 44
See application file for complete search history.

(56) References Cited

U.S. PATENT DOCUMENTS 3,695,951 A 10/1972 Hehms et al
4,432,816 A 2/1984 Kennedy et al.
4,963,203 A 10/1990 Halcomb et al.
6,183,569 B1 2/2001 Mohler
6,627,013 B2 9/2003 Carter et al.
2005/0199323 A1 * 9/2005 Nielson et al. ..... 149/19.3

OTHER PUBLICATIONS

Fischer, S.H. and Grubelich, M.C., Theoretical energy release of thermites, intermetallics, and combustible metals, 24th Int'l Pyrotechnics Seminar, Jun. 1, 1998, pp. 1-58,USA.
Mohler, Jonathan H.; Halcomb, Danny L.; Begeal, David R., An effective low-profile thermite torch, 15th Int'l Pyrotechnics Seminar, Jul. 9, 1990, pp. 1-16, USA.

* cited by examiner

*Primary Examiner*—Stanley Silverman
*Assistant Examiner*—James E McDonough
(74) *Attorney, Agent, or Firm*—Christopher A. Monsey

(57) ABSTRACT

A thermite formulation for use in thermite torch applications made up of from about 3 percent by weight to about 35 percent by weight Mg/Al alloy, from about 30 percent by weight to about 70 percent by weight CuO, and from about 15 percent by weight to about 35 percent by weight $MoO_3$. Additionally, the formulation may also include a binder material.

9 Claims, No Drawings

PYROTECHNIC THERMITE COMPOSITION

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates in general to thermite formulations, more particularly to thermite formulations for use in cutting torch applications, and most particularly to thermite formulations used in cutting torch applications with improved material perforation capability.

2. Description of the Related Art

Thermite is a formulation consisting of metals and metal oxides that cause an exothermic reaction. Original thermite formulations contained a stoichiometric mix of black iron oxide and aluminum. This formulation produces reaction products of aluminum oxide and molten iron. The molten iron has been used for welding, melting/destroying metallic objects, and as a thermal source for heat conductive material.

Many variants of the original thermite formulations have been developed for specific uses. Several thermite formulations have been created for use in thermite torches. Thermite torches direct the reaction products from a thermite reaction to a specific point to deliver large amounts of energy to a precise region of an object.

Thermite torch formulations have been developed and modified to enhance certain characteristics related to thermite reactions to improve their use. Such characteristics include gas production, temperature stability, heat transfer, shelf life, and material perforation. Of these characteristics for thermite torch applications, material perforation capability is paramount. For example, U.S. Pat. No. 4,963,203 discloses a thermite formulation that is stable at high and low temperatures; U.S. Pat. No. 6,627,013 discloses a thermite formulation that increases heat transfer by employing a heat transfer agent of $Cu_2O$; U.S. Pat. No. 4,432,816 discloses a thermite formulation that has increased shelf life by adding a fluorocarbon binder; and U.S. Pat. No. 3,695,951 discloses a thermite formulation that provides good material perforation capability using nickel, aluminum, ferric oxide, and powdered tetrafluoroethylene.

While these thermite formulations provide reasonable reaction products for thermite torch applications, the only above referenced formulation that provides sufficient material perforation capability for certain applications is the latter. However, the reaction products of that thermite formulation use starting materials and produce reaction products that are toxic.

Therefore, it is desired to provide a thermite formulation that provides excellent material perforation capability and uses starting materials and produces reaction products that have low toxicity.

SUMMARY OF THE INVENTION

The invention proposed herein comprises an improved thermite formulation for use in thermite torch applications. The formulation has excellent material perforation capability and uses low toxicity starting materials and produces low toxicity reaction products.

Accordingly, it is an object of this invention to provide a thermite formulation having excellent material perforation capability that may be used in thermite torch applications.

It is a further object of this invention to provide a thermite formulation that employs low toxicity starting materials and low toxicity reaction products.

It is yet a further object of this invention to provide a thermite formulation that employs starting materials having a low cost.

This invention meets these and other objectives related to improved thermite formulations by providing a thermite formulation for use in thermite torch applications comprising from about 3 percent by weight to about 35 percent by weight Mg/Al alloy, from about 30 percent by weight to about 70 percent by weight CuO, and from about 15 percent by weight to about 35 percent by weight $MoO_3$. Additionally, the formulation may also employ a binder material.

DESCRIPTION OF PREFERRED EMBODIMENTS

The invention, as embodied herein, comprises an improved thermite formulation for use in cutting torch applications. The thermite formulation has improved material perforation characteristics over previous thermite formulations and the starting materials and reaction products of the formulation have low toxicity.

In general, the thermite formulation of the present invention comprises a fuel of magnesium-aluminum alloy (magnalium) and a combination of oxidizers comprising CuO and $MoO_3$. Preferably, a small amount of binder material is added to the formulation.

In one embodiment, the formulation includes from about 3 percent by weight to about 35 percent by weight magnalium, from about 30 percent by weight to about 70 percent by weight CuO, and, from about 15 percent by weight to about 35 percent by weight $MoO_3$. About three percent of a binder material is preferably added to the formulation. In the most preferred embodiment of the invention the thermite formulation contains about 39.8 percent by weight CuO, about 33 percent by weight $MoO_3$, about 24.2 percent by weight magnalium, and about 3 percent by weight of a binder material.

Numerous tests of thermite formulations using a number of different fuels, oxidizers, and binders were conducted to develop the improved thermite formulation described herein. The testing devices and set-up are described below.

Experimental torches were constructed of NEMA Grade C phenolic. This material exhibits excellent heat resistance, strength, and is easily machined. The torches consisted of a lower nozzle body and an upper composition holding body. The nozzle body included a 82 degree converging nozzle and a 0.070" throat. The composition holding body consisted of a 0.5" diameter cavity 1.5" long. Pyrotechnic formulations were pressed inside this cavity.

The torch body was contained in a mild steel housing held together with four grade 8, ½" diameter, flange-head bolts. A worst-case pressure scenario was assumed and the test fixture was designed accordingly. Each bolt was rated for 150,000 psi. Wing nuts were originally used for rapid assembly and disassembly, but hex-head nuts were substituted after a test fixture exploded.

Replaceable target blocks were integrated into the steel housing. Target material consisted of 1.5" diameter by 1.5" long cylinders of 6061-T6 aluminum and 1020 steel. Aluminum targets were used for most experiments to help differentiate small differences in performance.

Tooling for pressing pyrotechnic compositions into torch bodies was constructed of half-hard brass. This tooling was replaced by stronger, 303 stainless steel tooling.

The formulation ratio/percentages of ingredients were determined by calculating the oxygen balance of each chemical reaction. 10 grams of candidate formulations were weighed out and placed into an antistatic container and thoroughly mixed for 30 seconds from behind a 1" thick Lexan shield. After the formulation was thoroughly mixed, it was placed into the top half of the torch body. The composition was then hydraulically compacted with 1,000 pounds of ram force. After pressing, the torch body was weighed and the mass of pyrotechnic composition was recorded.

A two-inch length of thermalite was inserted into the throat of the nozzle body and the converging section of the nozzle was filled with a slurry of acetone, fluorel, magnesium, and titanium. A Bickford-style safety fuse was used to ignite the thermalite and provide a safe delay. Upon drying, the bottom and top halves of the torch were fitted together and loaded into a steel housing.

Over 250 different formulations were tested, including formulations from a literature review. Material perforation performance was determined based on the mass of target material removed. In some cases, very deep penetrations were made into the target, but the channels formed were very narrow resulting in little target mass being removed. The formulation described herein performed significantly better than any other formulation tested. A formulation containing 39.8 percent by weight CuO, 33 percent by weight MoO3, 24.2 percent by weight magnalium, and 3 percent by weight polytetrafluoroethylene binder had a ratio of 1.61 of mass of metal removed by the mass of the formulation used. All of these ingredients are inexpensive, have a low toxicity, and are readily available. The next best performing formulation, which is similar to that disclosed in U.S. Pat. No. 4,963,203, had a ratio of only 0.86 and a formulation similar to that disclosed in U.S. Pat. No. 6,627,013 had a ratio of only 0.60.

Apparent from these results is that the mechanism for torch penetration is a combination of thermal, mechanical, and chemical actions. Compositions that produced the highest heats of reaction did not necessarily produce the best penetration. In addition, mixtures that generated high density reaction products or highest melting point products similarly did not produce the best penetration. No single chemical or physical property can adequately explain or predict the performance of a pyrotechnic torch composition. Furthermore, intergranular corrosion of target materials by torch reaction products may influence relative performance. Product density, hardness, melting point, and ductility coupled with reaction enthalpy all couple to determine performance.

The physical state of the reaction products was important to the performance of the torch system, and is determined by the heat output of the mixture and the melting and boiling points of the products. It is desirable to produce gas as well as liquid products with the thermite charge in a torch system.

While CuO has been employed in prior thermite formulations, $MoO_3$, while mentioned as an oxidizer candidate, has never been employed in practice to applicants' knowledge. The results of the tests discussed herein, however, have found that $MoO_3$ performed better in thermite torch formulations than other oxidizers due to a unique combination of physical properties that include the proper boiling points, density of reaction products, and heat of reaction that assist in giving a thermite formulation employing $MoO_3$ superior cutting capability. Since the results showed that the best cut was obtained using CuO and $MoO_3$, a combination of these oxidizers was selected for use in the present invention.

There were only three fuels that performed effectively with these metal oxides: magnesium, aluminum, and magnalium. All other metals exhibited poor results. However, one surprising result was that magnalium performed better than aluminum, magnesium, or a mechanical mixture of the component metals. This is most likely due to the fact that magnalium has a lower heat of reaction than the unalloyed mixture of these compounds. Therefore, magnalium was selected as the preferred fuel of the present formulation.

A series of formulations containing the same components in the same ratios, but with different particle sizes was also tested. Nanometer sized particle formulations were prepared by ultrasonically blending nanometer-sized oxidizer particles with nanometer-sized fuel particles under a hydrocarbon solvent (hexane). The nano-mixtures were much lower in density than mixtures of micron-sized fuel and oxidizer particles. The nano-mixtures exhibited higher sensitivity to mechanical stimuli and burned much faster than coarser mixtures. However, nano-mixtures yielded low target penetration because the low density of the composition cavity and the high burn rates typically cracked the torch. An additional disadvantage of nanometer-sized fuels is their lower active metal content due to their larger relative mass of metal oxide.

Formulations employing flake fuel particles also performed poorly compared to the same formulations employing atomized fuel particles. Atomized fuel particles have a higher bulk density than flake fuel particles and atomized fuel particles are not coated with stearic acid, as is flake material. The stearic acid coating decreases the burn rate of metal fuel particles and dilutes the very energetic metallic fuel with a less energetic organic fuel. The combination of lower density and lower caloric output explains the poor performance of flake fuel particle mixtures.

Therefore, it is preferred that atomized particles be used for the thermite formulation of the present invention in a size ranging from diameters of about 1 micron to about 70 microns, with almost preferable size being a diameter of about 30 microns.

While many known binder materials may be employed in the present inventions by those skilled in the art, the preferred binder material will be those that can also act as an oxidizer, such as polytetrafluoroethylene.

What is described are specific examples of many possible variations on the same invention and are not intended in a limiting sense. The claimed invention can be practiced using other variations not specifically described above.

What is claimed is:

1. A thermite formulation, comprising:

from about 3 percent by weight to about 35 percent by weight magnalium;

from about 30 percent by weight to about 70 percent by weight CuO; and, from about 15 percent by weight to about 35 percent by weight $MoO_3$.

2. The thermite formulation of claim 1, further comprising a binder material.

3. The thermite formulation of claim 1, wherein the magnalium, CuO, and $MoO_3$ comprise a diameter ranging from about 1 micron to about 70 microns.

4. The thermite formulation of claim 3, comprising about 24.2 percent by weight magnalium.

5. The thermite formulation of claim 4, comprising about 39.8 percent by weight CuO.

6. The thermite formulation of claim 5, comprising about 33.0 percent $MoO_3$.

7. The thermite formulation of claim 6, comprising about 3 percent binder material.

8. A thermite formulation, consisting essentially of:

from about 3 percent by weight to about 35 percent by weight magnalium;

from about 30 percent by weight to about 70 percent by weight CuO;

from about 15 percent by weight to about 35 percent by weight $MoO_3$; and, a binder material.

9. The thermite formulation of claim 8, consisting essentially of:

about 24.2 percent by weight magnalium;

about 39.8 percent by weight CuO;

about 33.0 percent by weight $MoO_3$; and, about 3 percent by weight binder material.

* * * * *

UNITED STATES PATENT AND TRADEMARK OFFICE

CERTIFICATE OF CORRECTION

PATENT NO. : 7,632,365 B1
APPLICATION NO. : 11/144849
DATED : December 15, 2009
INVENTOR(S) : D'Arche et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 369 days.

Signed and Sealed this

Second Day of November, 2010

David J. Kappos

David J. Kappos
*Director of the United States Patent and Trademark Office*